US006086412A

United States Patent [19]

Watt et al.

[11] Patent Number: 6,086,412

[45] Date of Patent: Jul. 11, 2000

[54] ELECTRICAL CONNECTOR FOR FLAT FLEXIBLE CIRCUITRY

[75] Inventors: Russell J. Watt, Chicago; Robert M. Fuerst, Maple Park; Yves LePottier, Geneva, all of Ill.

[73] Assignee: Molex Incorporated, Lisle, Ill.

[21] Appl. No.: 09/064,444

[22] Filed: Apr. 22, 1998

[51] Int. Cl.[7] ..... H01R 9/07

[52] U.S. Cl. ..... 439/496

[58] Field of Search ..... 439/495, 496, 439/354

[56] References Cited

U.S. PATENT DOCUMENTS

| | | | |
|---|---|---|---|
| 3,602,870 | 8/1971 | Willard | 339/17 |
| 3,825,878 | 7/1974 | Finger et al. | 339/17 F |
| 4,802,866 | 2/1989 | Balzano et al. | 439/496 |
| 5,080,595 | 1/1992 | Mouissie | 439/67 |
| 5,383,788 | 1/1995 | Spencer | 439/67 |
| 5,433,632 | 7/1995 | Cherney et al. | 439/495 |
| 5,529,502 | 6/1996 | Peltier et al. | 439/67 |

FOREIGN PATENT DOCUMENTS

| | | | |
|---|---|---|---|
| 2353139 | 10/1973 | Germany | 439/496 |

*Primary Examiner*—Renee Luebke
*Assistant Examiner*—J. F. Duverne
*Attorney, Agent, or Firm*—Stacey E. Caldwell

[57] ABSTRACT

A connector (10,10A,10B) is provided for electrically interconnecting the conductors (12,40) of a flat mating connecting device. The connector includes a body member (22,48, 50) having an edge about which the flexible circuit is wrapped. Locating pegs (20) on the body member engage and hold the flexible circuit (14,42) about the edge. A resilient strip (30) on the body member at the edge thereof spring loads the flexible circuit to enhance engagement thereof with the locating pegs.

17 Claims, 5 Drawing Sheets

ELECTRICAL CONNECTOR FOR FLAT FLEXIBLE CIRCUITRY

FIELD OF THE INVENTION

This invention generally relates to the art of electrical connectors and, particularly, to connectors for electrically interconnecting flat flexible circuitry.

BACKGROUND OF THE INVENTION

A flat flexible circuit conventionally includes an elongated flat flexible dielectric substrate having laterally spaced strips of conductors on one or both sides thereof. The conductors may be covered with a thin, flexible protective layer on one or both sides of the circuit. If protective layers are used, cutouts are formed therein to expose the underlying conductors at desired contact locations where the conductors are to engage the conductors of a complementary mating connecting device which may be a second flat flexible circuit, a printed circuit board or the terminals of a mating connector.

A wide variety of connectors have been designed over the years for terminating or interconnecting flat flexible circuits with complementary mating connecting devices. Major problems continue to plague such connectors, particularly in the area of cost and reliability. Not only is the direct material costs of such connectors unduly high, but an undue amount of labor time is required in assembling such connectors. The present invention is directed to solving these problems by providing an extremely simple, inexpensive and reliable connector structure not heretofore available.

SUMMARY OF THE INVENTION

An object, therefore, of the invention is to provide a new and improved connector for flat flexible circuitry.

In the exemplary embodiment of the invention, a new and improved male connector is shown for electrically interconnecting the conductors of a flat flexible circuit to the conductors of a complementary mating connecting device. However, the concepts of the invention are not limited to male connectors. The connector includes a body member having an edge about which the flexible circuit is wrapped, with the conductors of the circuit facing away from the body member. Locating means are provided on the body member for engaging and holding the flexible circuit about the edge of the body member. Resilient means are provided on the body member at the edge thereof for spring loading the flexible circuit to enhance the engagement thereof with the locating means.

As disclosed herein, the locating means include a plurality of locating pegs projecting from the body member into respective locating holes in the flexible circuit. Preferably, such locating pegs and respective locating holes are provided on each opposite side of the resilient means. The male body member is disclosed as being elongated, and the resilient means is formed by a longitudinal resilient strip along the edge of the body member.

The body member of the preferred embodiment is unitarily molded of relative rigid plastic material, and the resilient means comprises a molded-in-place component of an elastomeric material. For instance, the resilient means may be a silicone rubber structure.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims.

The invention, together with its objects and the advantages thereof, may be best understood by reference to the following description taken in conjunction with the accompanying drawings, in which like reference numerals identify like elements in the figures and in which.

DETAILED DESCRIPTION OF THE PREFERRED EMBODIMENTS

Figure 1:
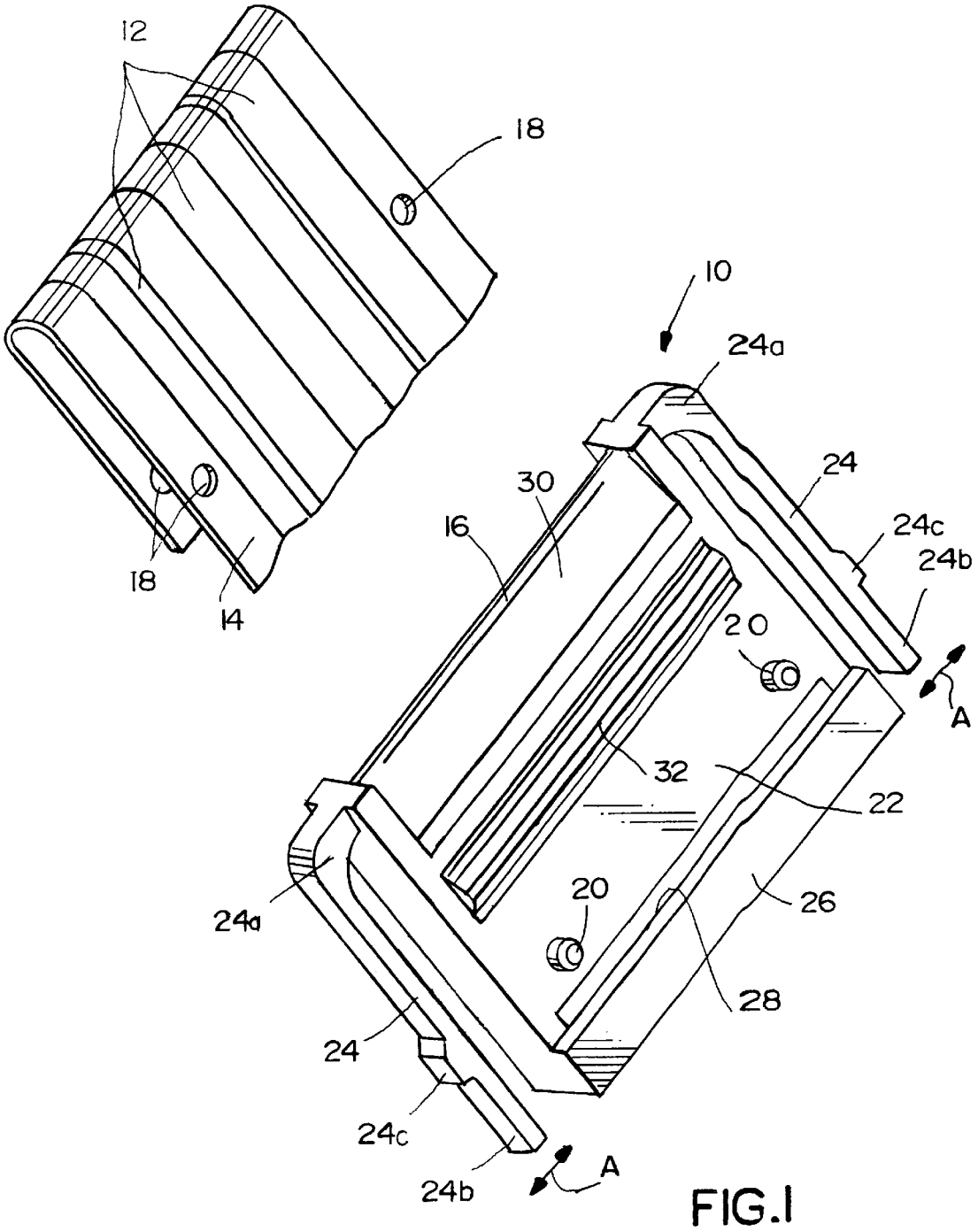
FIG. 1 is a top perspective view of a first embodiment of a connector incorporating the concepts of the invention.
Figure 2:
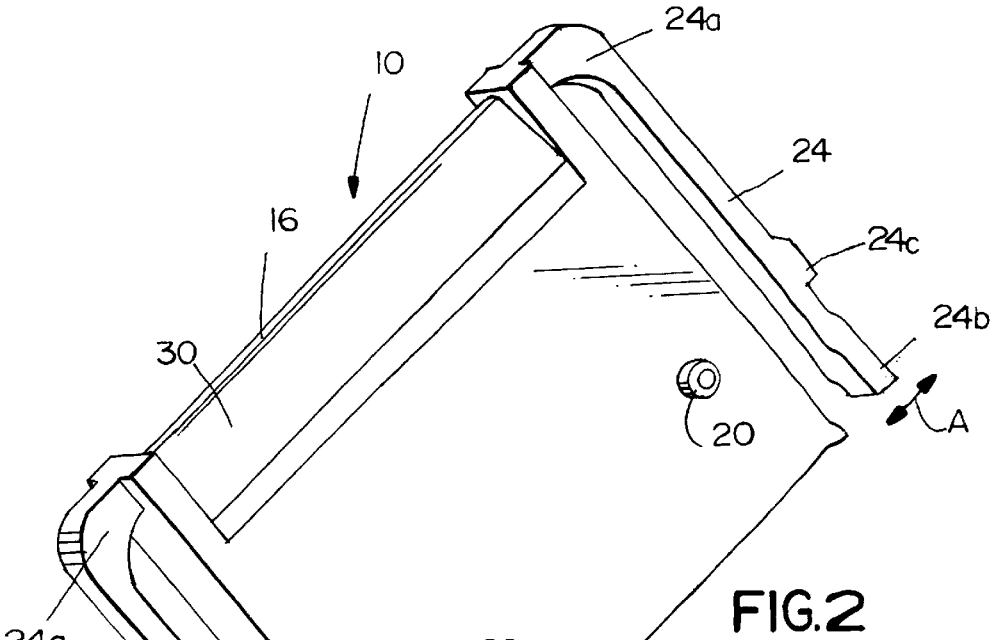
FIG. 2 is a bottom perspective view of the connector of FIG. 1.

Referring to the drawings in greater detail, and first to FIGS. 1 and 2, a first embodiment of a male connector, generally designated 10, is shown for electrically interconnecting the conductors 12 of a flat flexible circuit or cable 14 to the conductors of a complementary mating connecting device (not shown). For instance, male connector 10 can be mated with a complementary female connector by inserting a leading edge 16 of the male connector into an appropriate receptacle of the female connector. In some applications, the male connector could be connected to another complementary male connector. In these various applications, flat flexible circuit 14 is wrapped around leading edge 16 of the connector, and locating holes 18 in the circuit are positioned over locating pegs 20 on opposite sides of the male connector.

More particularly, male connector 10 includes a male body member 22 about which flat flexible circuit 14 is wrapped. The male body member is generally flat and elongated and includes a pair of cantilevered latch arms 24 at opposite ends thereof. The body member, including the latch arms, is unitarily molded of relatively rigid dielectric material such as plastic or the like. Cantilevered latch arms 24 are joined to the body member at proximal ends 24*a* of the latch arms near opposite ends of leading edge 16 of the connector. Therefore, free ends 24*b* of the latch arms can flex in the direction of double-headed arrows "A". A pair of latch hooks 24*c* project outwardly of latch arms 24 for engagement with appropriate latch means on the complementary mating connecting device. Finally, a raised rib or flange 26 extends longitudinally along the top rear edge of the body member to define a slot 28 therebeneath and through which flat flexible circuit 14 extends, as best seen in FIG. 5 described hereinafter.

Still referring to the embodiment of FIGS. 1 and 2, the invention contemplates the provision of resilient means in the form of an elongated resilient component 30 which extends along and defines leading edge 16 of the connector for spring loading flexible circuit 14 to enhance the engagement thereof with locating pegs 20. Resilient component 30 is a molded-in-place strip fabricated of elastomeric material, such as silicone rubber.

Finally, connector 10 (FIGS. 1 and 2) includes a molded-in-place resilient backing rib 32 (FIG. 1) which extends longitudinally of the width of body member 22 and engages the underside of flexible circuit 14 to bias conductors 12 of the circuit against the conductors of the complementary mating connecting device.

Figure 3:
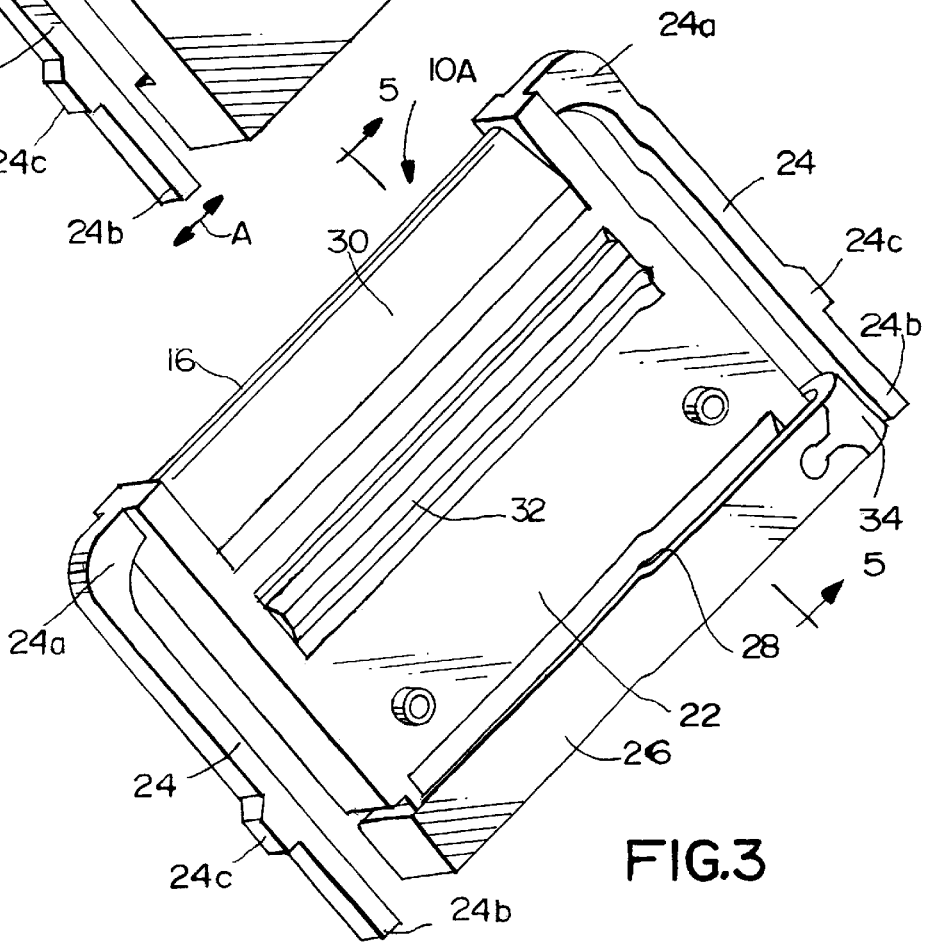
FIG. 3 is a top perspective view of a second embodiment of the connector.
Figure 4:
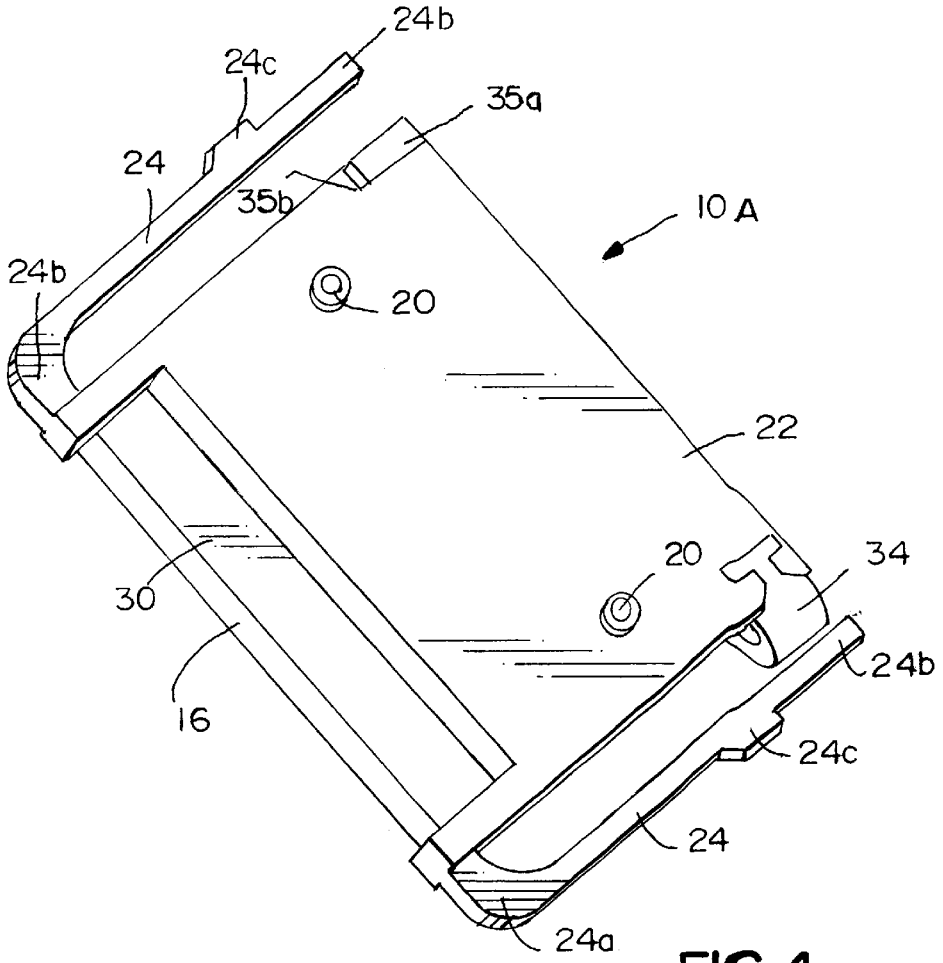
FIG. 4 is a bottom perspective view of the connector of FIG. 3.
Figure 5:
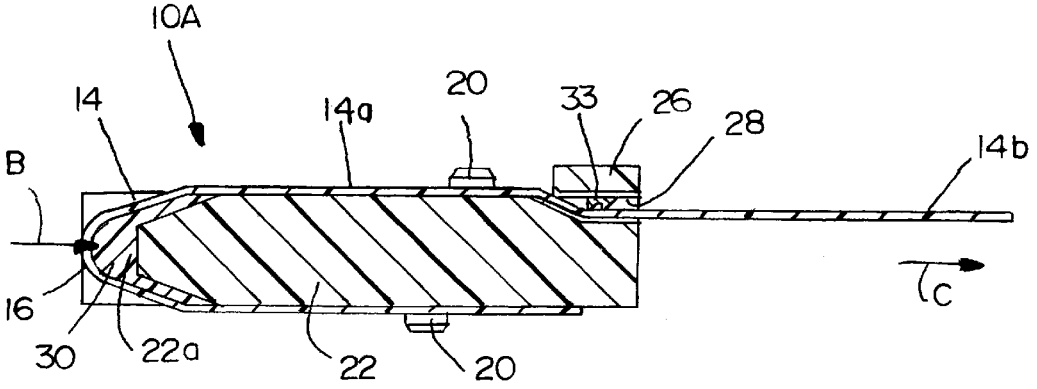
FIG. 5 is a section taken generally along line 5—5 of FIG. 3.

FIGS. 3–5 show a second embodiment of a male connector, generally designated 10A, which is substantially identical to connector 10 (FIGS. 1 and 2) except that connector 10A includes a resilient strain relief member 33 on the underside of flange 26 as best seen in FIG. 5. Consequently, like numerals have been applied in FIGS. 3–5 designating like components of male connector 10A corresponding to the components described above in relation to connector 10 in FIGS. 1 and 2.

Also in the embodiment of FIGS. 3 and 4, flange 26 is a separate rigid plastic component joined to body member 22 by a living hinge 34. The living hinge is a molded-in-place component of elastomeric material such as silicone rubber. The opposite end of separate flange 26 has a hooked latch 35*a* for latching over a surface 35*b* of body member 22. Therefore, the flange can be unlatched to open slot 28 significantly to enable easy positioning of the flexible circuit in the slot.

Before proceeding with a description of strain relief member 33, FIG. 5 clearly shows how resilient component 30 is molded-in-place about a leading edge 22*a* of body member 22. It also can be seen how flexible circuit 14 is wrapped around leading edge 16 of the connector defined by resilient component 30. The invention contemplates that locating holes 18 (FIG. 1) in flexible circuit 14 be spaced such that, when the holes are positioned about locating pegs 20 as seen in FIG. 5, the flexible circuit will be wrapped tightly about resilient component 30, even to the extent of slightly compressing the resilient component in the direction of arrow "B". Therefore, the resilient component is effective to spring load the flexible circuit to enhance the engagement thereof with locating pegs 20. In other words, the resilient component is effective to take out any looseness or slack in the flexible circuit which, otherwise, might simply fall off of the locating pegs.

Referring specifically to FIG. 5, when flexible circuit 14 is fully connected about either male connector 10 or 10A, a first length 14*a* of the circuit is disposed on top of body member 22, and a second length 14*b* of the circuit extends beneath flange 26 and away from the rear of the body member. It can be seen that the second length 14*b* of the circuit is in a plane offset from the plane of the first length 14*a* of the circuit. Resilient strain relief member 33 engages the top of length 14*b* of the circuit in its plane offset from length 14*a* of the circuit. Therefore, pulling forces on the flexible circuit in the direction of arrow "C" will have a tendency to bias the circuit against strain relief member 33 which is resilient and compressible to provide a degree of give or longitudinal movement to the circuit, rather than allowing all of the pulling forces to be translated directly to locating pegs 20 at the top of the connector. Like resilient spring-loading component 30, resilient strain relief member 33 is a molded-in-place structure on the underside of flange 26 and is fabricated of such elastomeric material as silicone rubber.

Figure 6:
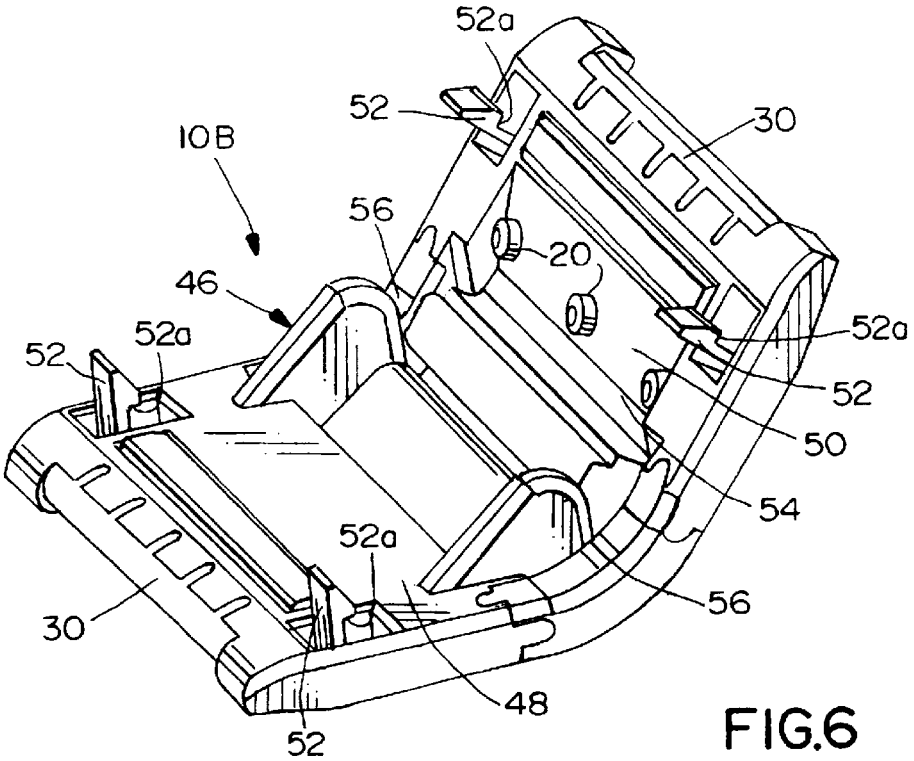
FIG. 6 is a perspective view of a third embodiment of a connector incorporating the concepts of the invention, with the connector in open condition.
Figure 7:
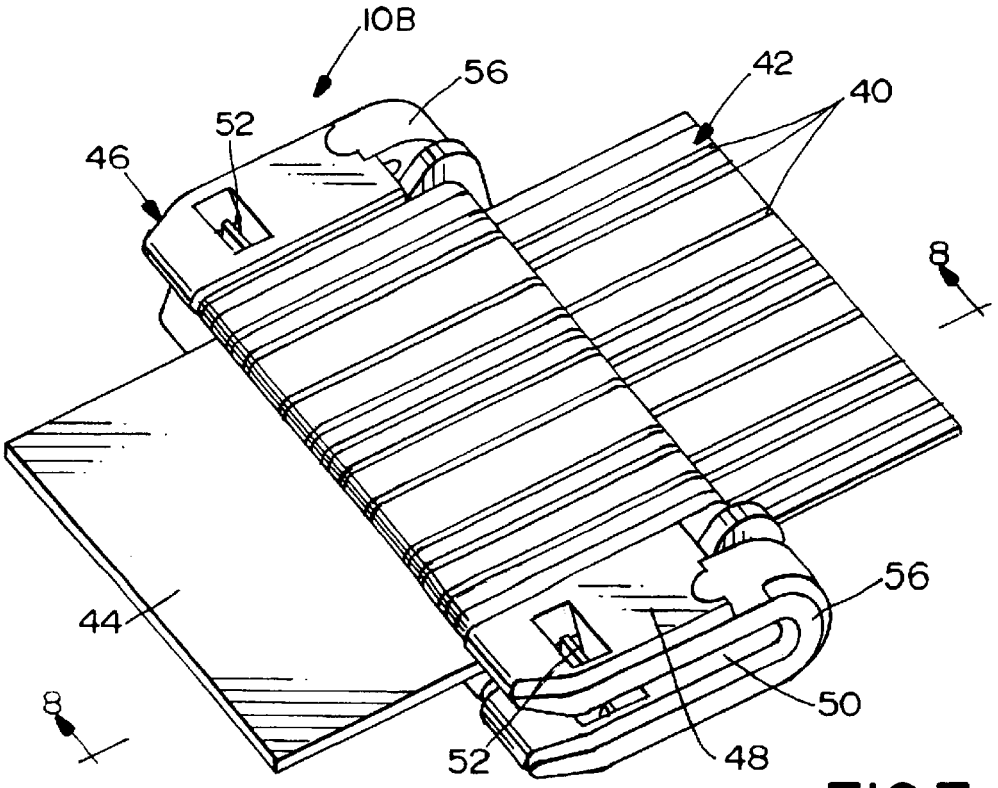
FIG. 7 is a perspective view of the connector of FIG. 6 in closed condition, interconnecting a flexible circuit with a printed circuit board.
Figure 8:
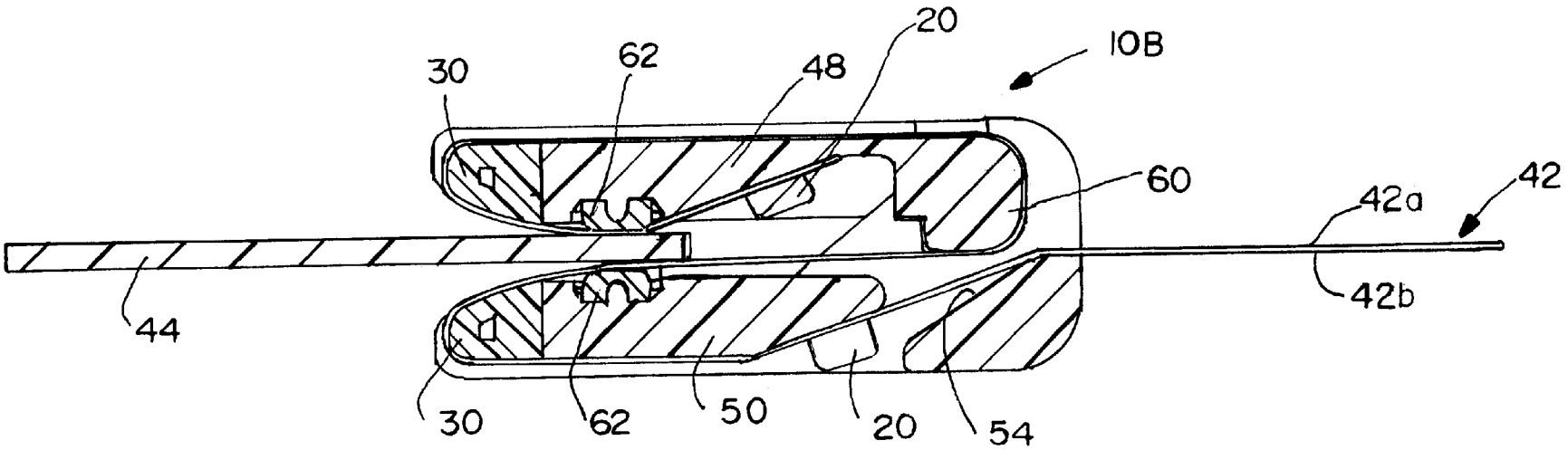
FIG. 8 is a section taken generally along line 8—8 of FIG. 7.

Referring to FIGS. 6–8, a third embodiment of a connector, generally designated 10B, is shown for interconnecting the conductors 40 on opposite sides of a flat flexible circuit, generally designated 42, to the circuit traces on opposite sides of a printed circuit board 44 as seen in FIGS. 7 and 8. More particularly, connector 10B includes a multi-part housing, generally designated 46, which is formed by a pair of rigid housing parts 48 and 50. Each housing part is a one-piece structure unitarily molded of dielectric material such as rigid plastic. The housing parts are movable between open positions shown in FIG. 6 to facilitate loading of flexible circuit 42, and closed positions shown in FIGS. 7 and 8 for interconnecting the conductors of the flexible circuit to the circuit traces of printed circuit board 44. The housing parts have complementarily interengaging latch arms 52 which are flexible and molded integrally with the housing parts. The latch arms are cantilevered and include complementarily interengaging latch hooks 52*a* when the housing parts are in their closed positions. Housing part 50 has an elongated slot 54 for the passage therethrough of flexible circuit 42 as best seen in FIG. 8. Finally, each housing part includes a resilient spring-loading component 30 at edges thereof about which the flexible circuit is wrapped similar to connectors 10 and 10A.

The invention contemplates that relatively rigid plastic housing parts 48 and 50 be joined by flexible hinge means provided by a pair of molded-in-place hinge components 56. The hinge components are molded of elastomeric material such as silicone rubber. The hinge components accommodate movement of the rigid housing parts from their open positions shown in FIG. 6 to their closed positions shown in FIGS. 7 and 8.

FIG. 8 shows how flexible circuit 42 is interconnected to printed circuit board 44 by connector 10B. More particularly, flexible circuit 42 is a two-sided circuit in that it has conductors on both the top side 42*a* and the bottom side 42*b* as viewed in FIG. 8. Correspondingly, printed circuit board 44 will have circuit traces on both sides thereof. The flexible circuit is threaded through slot 54 in housing part 50, beneath the housing part and around resilient spring-loading member 30 at the leading edge of the housing part, whereupon bottom side 42*b* of the flexible circuit becomes the top side for engaging circuit traces on the bottom of printed circuit board 44. Still referring to FIG. 8, the circuit is wrapped about a rear edge 60 of housing part 48, over the top of the housing part, around resilient spring-loading component 30 at the front edge of the body part and into engagement with the top of printed circuit board 44. At this point of engagement, the top side 42*a* of the flexible circuit becomes the bottom side thereof for engaging the circuit traces on the top of the circuit board. Both housing parts 48 and 50 are shown in FIG. 8 to include locating pegs 20 for insertion into appropriate locating holes in the flexible circuit to tightly wrap the circuit about resilient spring-loading members 30, as described above in relation to connectors 10 and 10A. Both housing parts 48 and 50 also include molded-in-place resilient backing structures 62 for biasing the flexible circuit against the top and bottom of the printed circuit board.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A male connector for electrically interconnecting conductors of a flat flexible circuit to conductors of a complementary mating connecting device, comprising:

a male body member having an edge about which the flexible circuit is wrapped with the conductors of the circuit facing away from the body member;

locating means in the form of pegs integrally formed on the body member projecting into respective locating holes in the flexible circuit for engaging and holding the flexible circuit about the edge of body member; and resilient means integrally formed on the body member at the edge thereof for spring loading the flexible circuit to enhance the engagement thereof with said locating means.

2. The male connector of claim 1, including at least one of said locating pegs and a respective locating hole on each opposite side of said resilient means.

3. The male connector of claim 1 wherein said male body member is elongated and said resilient means comprises a longitudinal resilient strip along said edge.

4. The male connector of claim 3 wherein said locating means are disposed on each opposite side of said resilient strip.

5. The male connector of claim 1 wherein said resilient means comprises a molded-in-place component.

6. The male connector of claim 5 wherein said body member is unitarily molded of plastic material and said molded-in-place component is of an elastomeric material.

7. The male connector of claim 5 wherein said resilient component is molded substantially about the edge of the body member.

8. The male connector of claim 1 wherein said body member is molded of relatively rigid plastic material.

9. The male connector of claim 1 wherein said resilient means is of an elastomeric material.

10. A male connector for electrically interconnecting conductors of a flat flexible circuit to conductors of a complementary mating connecting device, comprising:

an elongated male body member unitarily molded of relatively rigid plastic material and having an edge about which the flexible circuit is wrapped, with the conductors of the circuit facing away from the body member;

locating means in the form of pegs integrally formed on the body member projecting into respective locating holes in the flexible circuit for engaging and holding the flexible circuit about the edge of body member; and an elongated resilient strip molded-in-place along the edge of the body member, the strip being of elastomeric material for spring loading the flexible circuit to enhance the engagement thereof with said locating means.

11. The male connector of claim 10 wherein said resilient strip is of silicone rubber.

12. The male connector of claim 10, including at least one of said locating pegs and a respective locating hole on each opposite side of said resilient strip.

13. A connector for electrically interconnecting conductors of a flat flexible circuit to conductors of a complementary mating connecting device, comprising:

a body member on which the flexible circuit is positioned;

locating means in the form of pegs integrally formed on the body member projecting into respective locating holes in the flexible circuit for engaging and holding the flexible circuit thereon; and resilient means integrally formed on the body member engageable with the flexible circuit for spring loading the flexible circuit to enhance the engagement thereof with said locating means.

14. The connector of claim 13 wherein said resilient means comprises a molded-in-place component.

15. The connector of claim 14 wherein said body member is unitarily molded of plastic material and said molded-in-place component is of an elastomeric material.

16. The connector of claim 13 wherein said body member is molded of relatively rigid plastic material.

17. The connector of claim 1 wherein said resilient means is of an elastomeric material.

* * * * *